US007055353B2

(12) United States Patent
Cowie

(10) Patent No.: US 7,055,353 B2
(45) Date of Patent: Jun. 6, 2006

(54) PROGRESSIVE STAMPING DIE

(76) Inventor: Ralph Cowie, 1675 Kirkway La., Bloomfield Hills, MI (US) 48302

( * ) Notice: Subject to any disclaimer, the term of this patent is extended or adjusted under 35 U.S.C. 154(b) by 35 days.

(21) Appl. No.: 10/710,687

(22) Filed: Jul. 28, 2004

(65) Prior Publication Data

US 2006/0021414 A1 Feb. 2, 2006

(51) Int. Cl.
*B21D 45/00* (2006.01)
*B21D 28/26* (2006.01)

(52) U.S. Cl. ..... 72/4; 72/336; 72/334; 72/404

(58) Field of Classification Search ..... 72/334, 72/335, 404, 339, 336, 337, 329, 330, 4
See application file for complete search history.

(56) References Cited

U.S. PATENT DOCUMENTS

| | | | | |
|---|---|---|---|---|
| 3,263,472 | A * | 8/1966 | Arndt et al. | 72/324 |
| 3,338,084 | A * | 8/1967 | Stegman, Sr. | 72/333 |
| 3,381,514 | A * | 5/1968 | Starita et al. | 72/335 |
| 4,205,548 | A * | 6/1980 | Bothner et al. | 72/404 |
| 4,733,552 | A * | 3/1988 | Lefils | 72/405.06 |
| 4,839,952 | A * | 6/1989 | Yokoyama | 29/893.33 |
| 5,016,461 | A * | 5/1991 | Walker et al. | 72/336 |

* cited by examiner

*Primary Examiner*—Daniel C. Crane
(74) *Attorney, Agent, or Firm*—John A Artz; Artz & Artz

(57) ABSTRACT

A progressive stamping die system and method of operation providing dimensionally accurate flat stamped parts. A biasing mechanism is provided in actual alignment with a coin punch member in order to accurately control the configuration and planar accuracy of the stamped parts being formed.

40 Claims, 5 Drawing Sheets

PROGRESSIVE STAMPING DIE

BACKGROUND OF INVENTION

A system and method for producing a stamped part from a progressive die, particularly a stamped part with multiple operations from coil stock material.

Progressive dies used to make stamped parts, particularly metal parts, are in common use today. Stamped parts made from progressive dies are in common use in many industries, such as the automobile industry. These parts include, for example, door bracket members.

One of the uses for stamped metal parts today relates to the formation of cooling conduits in radiators for vehicles. Stamped ring members similar to washers are formed by progressive die stamping processes, and then coated with copper and braised together to form a radiator conduit.

Stamped ring members used for forming radiator conduits should have a thickness and flatness within a certain range of tolerances in order to provide a commercially satisfactory conduit. Ring members which are out of tolerance can cause openings in the conduits causing leaks in the radiator which are unacceptable.

Thus, the need exists for forming stamped metal parts by progressive die stamping systems and methods which are formed to certain configurations and maintained with dimensions within certain tolerances. A need also exists for improved progressive die stamping systems and methods in general.

SUMMARY OF INVENTION

An improved progressive die stamping system and method is provided in accordance with the present invention. The die members are utilized in a stamping (press) machine for forming products from work pieces, such as strips of coiled steel. The die members have conventional alignment mechanisms for maintaining their mating alignment during the stamping process. One or more sets of punch-type members are provided in one of the die members and are used to pierce the ring members. Corresponding mating anvils and openings in the other die member are used to blank the ring members.

A coin punch in that same die member also cuts the outer perimeter around the opening thereby creating the ring. An anvil and biasing mechanism are provided in the second die member in axial alignment with the coin punch member and are used to maintain the desired dimensional thickness and flatness of the ring members that are being formed. The biasing mechanism can be a gas spring member, a mechanical spring member (such as a wavy washer), or the like.

Knockout punch members are also provided for removing the formed product from the work piece. Also, at least one pilot member is provided for indexing the work piece member in the progressive die members. Openings and chutes are also provided for removing the scrap material made by the pierce punch member and for collecting the completed ring members which are removed from the work piece by the knockout punch member.

DETAILED DESCRIPTION

Figure 1:
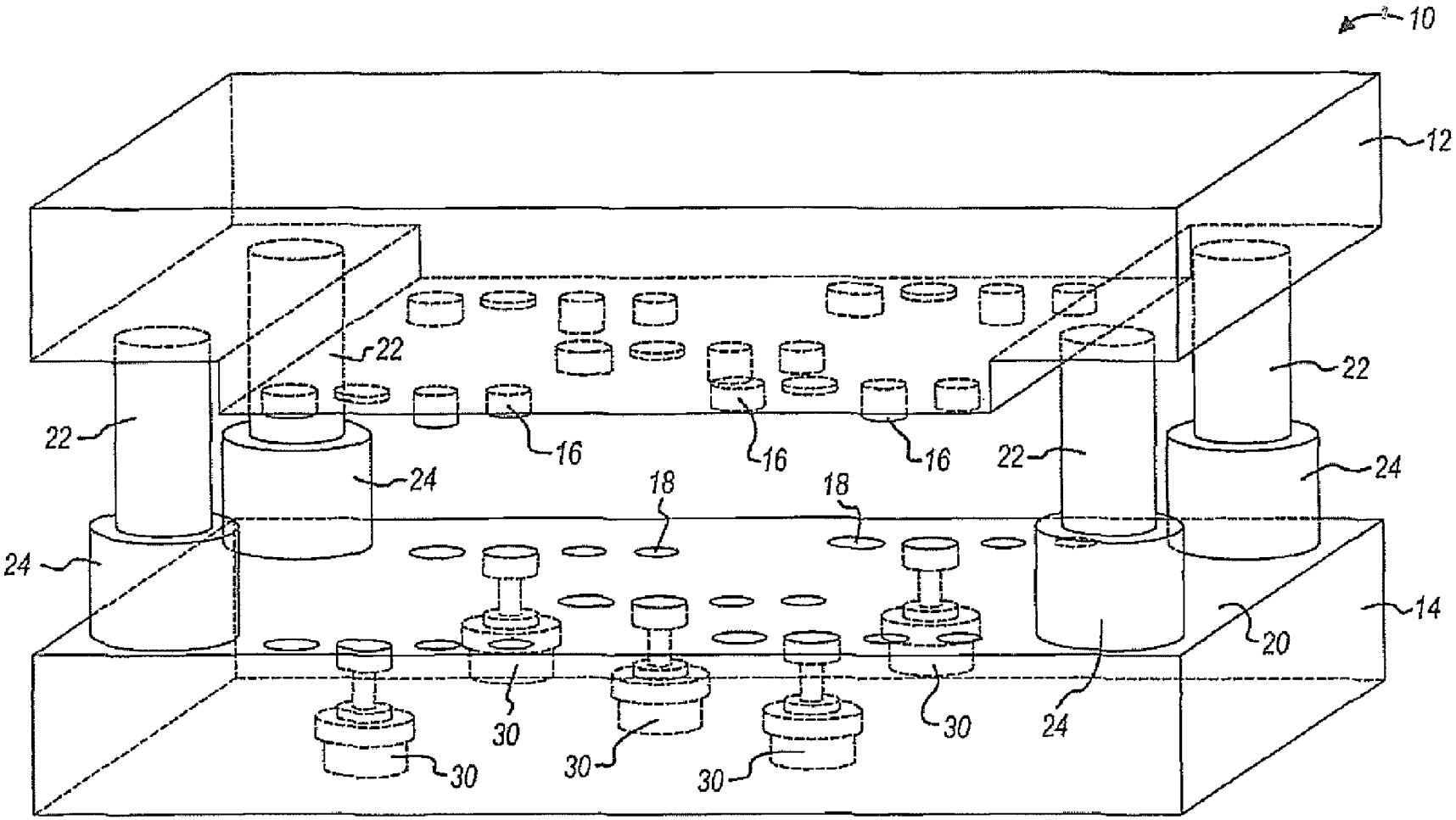
FIG. 1 schematically illustrates a progressive stamping die, partially in accordance with the present invention.

A progressive stamping die partially in accordance with the present invention is illustrated schematically in FIG. 1 and referred to generally by the reference numeral 10. The progressive die 10 includes an upper or first die member 12 and a lower or second die member 14. In general, the upper die member 12 includes a plurality of punch members 16, which are operated by a punch shoe or the like (not shown) when the progressive stamping die 10 is positioned in a stamping (press) machine. The lower die member 14 typically includes a number of openings or chutes 18 which are used for removing scrap or products from the work piece which is passed along the upper surface 20 in between the two stamping die members 12 and 14.

The progressive stamping die 10 also includes an alignment mechanism which comprises a plurality of postmembers 22 which are attached to the upper die member 12 and a plurality of cup or socket members 24 which are provided as part of the lower die member 14. Alignment mechanisms of this type are in common use today with progressive stamping dies and no further explanation or description is needed here. Persons of ordinary skill in the art will have applicable knowledge and experience in order to provide alignment mechanisms for progressive stamping dies in accordance with the present invention.

Similarly, hole and piece punch members, such as indicated generally reference numeral 16 in FIG. 1, are commonly used in progressive stamping die mechanisms and are known to persons of ordinary skill in the art. In the same manner, openings and chute members, such as openings 18 indicated in FIG. 1 are commonly used in progressive stamping dies and do not have to be described in detail herein.

In operation, the progressive stamping die 10 is positioned in a stamping (press) machine between an upper stamping member, such as a punch shoe and a lower stamping member, such as the bed of the stamping press. The upper die member 12 is fixedly secured to the punch shoe, such as by bolts or other mechanical securing mechanisms while the lower die member 14 is physically attached to the bed of the press. In this manner, when the stamping press is operated, the first and second die members are brought together with considerable force. The force of the stamping machine or press causes the punch members to pierce or deform the work piece member positioned on the lower die member in a desired manner.

In a progressive stamping die, the work piece moves across the stamping die from one end to the other in timed steps or stages. At each step or stage, one or more operations are performed on the work pieces, such as forming a curve or configuration of some sort, or forming a piercing operation of some type. Thus, when the work piece exits from the stamping die, it is configurated or formed in a desired manner. In this regard, a work piece can be subjected to progressive stamping dies in succession in order to form completed parts or products.

Although some of the components in FIG. 1 are conventional for progressive stamping dies, FIG. 1 also includes a plurality of biasing mechanisms 30 which are believed to be unique and part of the present invention. These are explained in more detail below.

Figure 6:
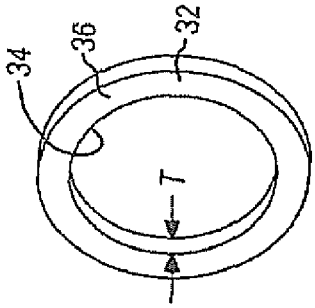
FIGS. 6 and 7 illustrate two embodiments of ring-type members which can be formed with the progressive stamping die in accordance with the present invention.

As indicated above, the present invention is particularly useful in forming stamped metal parts and components that have specified configurations and dimensional tolerances. For example, the present invention is useful in producing accurately dimensioned coined ring members, such as ring member 32 as shown in FIG. 6. The ring member 32 includes a central opening 34 and an annular ring 36. The ring member 32 has a specified thickness T. As ring member 32 is used to form conduits in radiators for automobiles and other vehicles, it is necessary to maintain the thickness T within a certain range of tolerances. This means that the ring member 32 has to have a predetermined planar configuration or flatness to it. With the present invention, that planar configuration and flatness can be maintained on a commercially feasible manufacturing basis.

Figure 7:
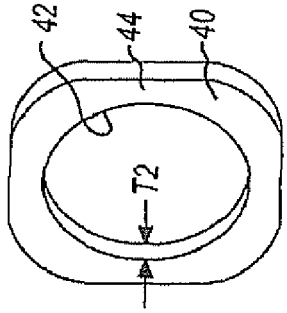

It is to be understood that the present invention can also be used for producing stamped metal parts other than ring members, such as 32. Another form of stamped metal product which can be made with the present invention is shown in FIG. 7. Ring member 40 is similar to ring member 32, in that it has a central opening 42 and an outer square-type annular ring member 44 and also a pre-specified thickness T2. Of course, other products and shapes of ring members and the like can be formed with the present invention as would be understood by persons of ordinary skill in the art.

Figure 2A:
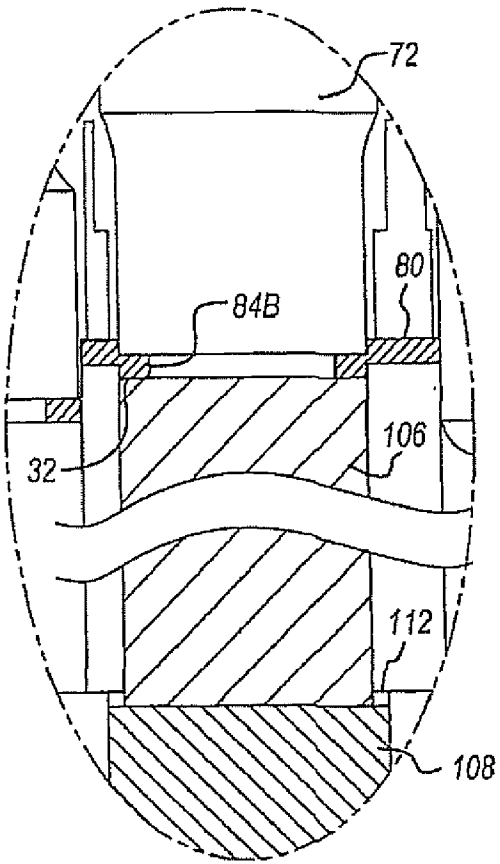
FIG. 2A is an enlarged view of a portion of FIG. 2.
Figure 2:
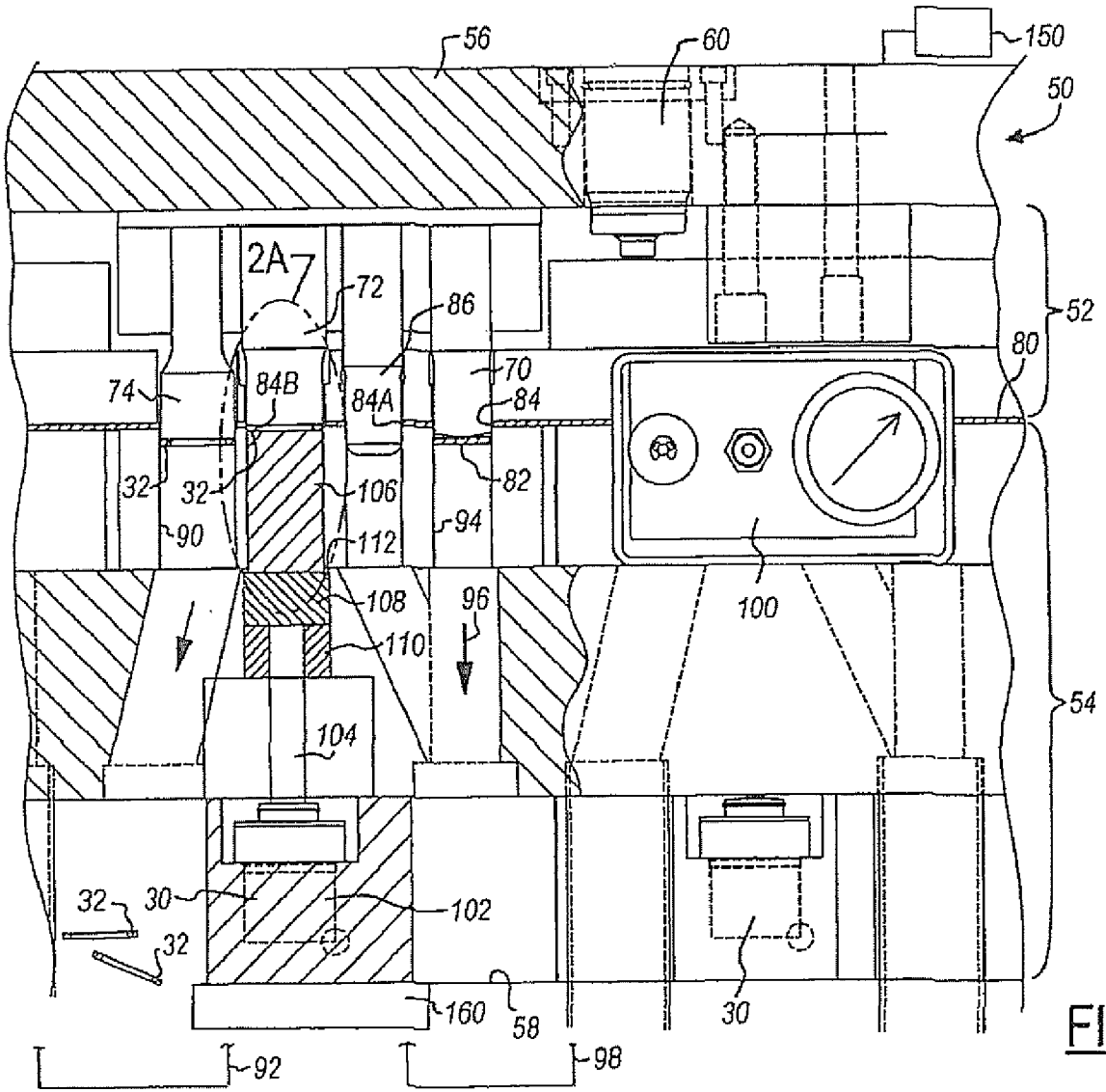
FIG. 2 is a cross-section of a progressive stamping die in accordance with the present invention.

A cross-section of a preferred embodiment of a progressive stamping die in accordance with the present invention is shown in FIG. 2 and indicated generally by the reference numeral 50. The die 50 has an upper or first die member 52 and a lower or second die member 54. As shown, each of the die members 52 and 54 are formed of a number of pieces or plate members, although they can be referred to generally as single members since they move and operate as unitary configurations.

The progressive die has a punch shoe 56 which is used to operate the punches in the first die member 52 while the second die member 54 is attached to the bed 58 of the press (stamping machine). A plurality of flange bases 60 are used to support the first die member 52.

As indicated in FIG. 2, a series of punch members are provided in the first die member 52. The punch members include a pierce punch member 70, a coin punch 72 and a knockout punch member 74. The work piece member which is moved progressively along the upper surface of the second die member 54, is indicated by reference numeral 80. The work piece can be a piece of steel material from a coil. As the work piece 80 moves through the progressive die 50, the pierce punch member 70 punches out a piece of material 82 and thus forms an opening 84 in the work piece. A pilot member 86 is then moved into position in the opening 84A in the second step of the progressive stamping process. The pilot member indexes the work piece member in the die 50 so that it is firmly and accurately positioned for subsequent stamping operations.

The coin punch member 72 in the next step of the progressive stamping die process forms the outer periphery configuration of the ring member 32. In this regard, the distance of travel of the coin punch is only sufficient to pass part way through the thickness of the work piece member 80. In this manner, only a portion of the work piece member is actually pierced by the coin punch member. The remainder of the exterior perimeter circumference of the ring member 32 is fractured due to the force of the stamping process. An enlarged view of this situation is shown in FIG. 2A.

Once the ring member 32 is fully formed, the knockout punch member 74 is then utilized in the next station in the progressive stamping die process to push out or "knockout" the ring member 32 from the work piece 80. At this point, as shown in FIG. 2, the ring member then proceeds into chute 90 where it falls into a collection box or container 92.

The pieces of material 82 which are punched out of the work piece 80 by the pierce punch 70 proceed along the opening or chute 94 as indicated by the arrow 96 in FIG. 2 and fall into a scrap bin or container 98.

As conventional with progressive stamping dies, a counter mechanism 100 is provided in order to aid in the progressive stamping die process.

In order to form stamped metal parts, such as ring member 32 of accurate configuration dimensions, biasing mechanism 30 is utilized. The mechanism 30 is positioned in axial alignment with the coin punch member 72, as shown in FIG. 2. The biasing mechanism 30 includes a spring member 102, together with a return pin member 104, a solid anvil type member (a/k/a "puck") 106, a bottoming disk member 108 and a bottoming ring member 110. The puck member, bottoming disk member and bottoming ring member are preferably made of hardened tool steel and act together as an anvil for the coin punch member in order to accurately stamp and form the product, such as ring member 32. The spring member 102 is preferably a gas spring mechanism, but also could be a mechanical spring member, such as a wavy spring-type washer, or a disc spring washer, or a series of spring washers.

A gas spring member which can be utilized with the present invention is the "Tanker 2" nitrogen gas spring from Teledyne Fluid Systems. Mechanical spring members which can be utilized with the present invention include disc springs from Lamina, Inc.

As shown in FIGS. 2 and 2A, the bottoming disk member 108 mates and meets with shoulder 112 in the second die member 54. The shoulder prevents the biasing mechanism from raising the anvil or puck member above a predetermined level.

In order to have a more efficient manufacturing operation, preferably a series or sets of punch members are provided in the stamping die so that a plurality of stamped metal products, such as ring members 32, can be formed as the work piece moves through the die. In this regard, in the embodiment shown and described herein, five ring members 32 are formed. Thus, five sets or series of punch members and corresponding chute members and biasing members are provided.

Figure 3:
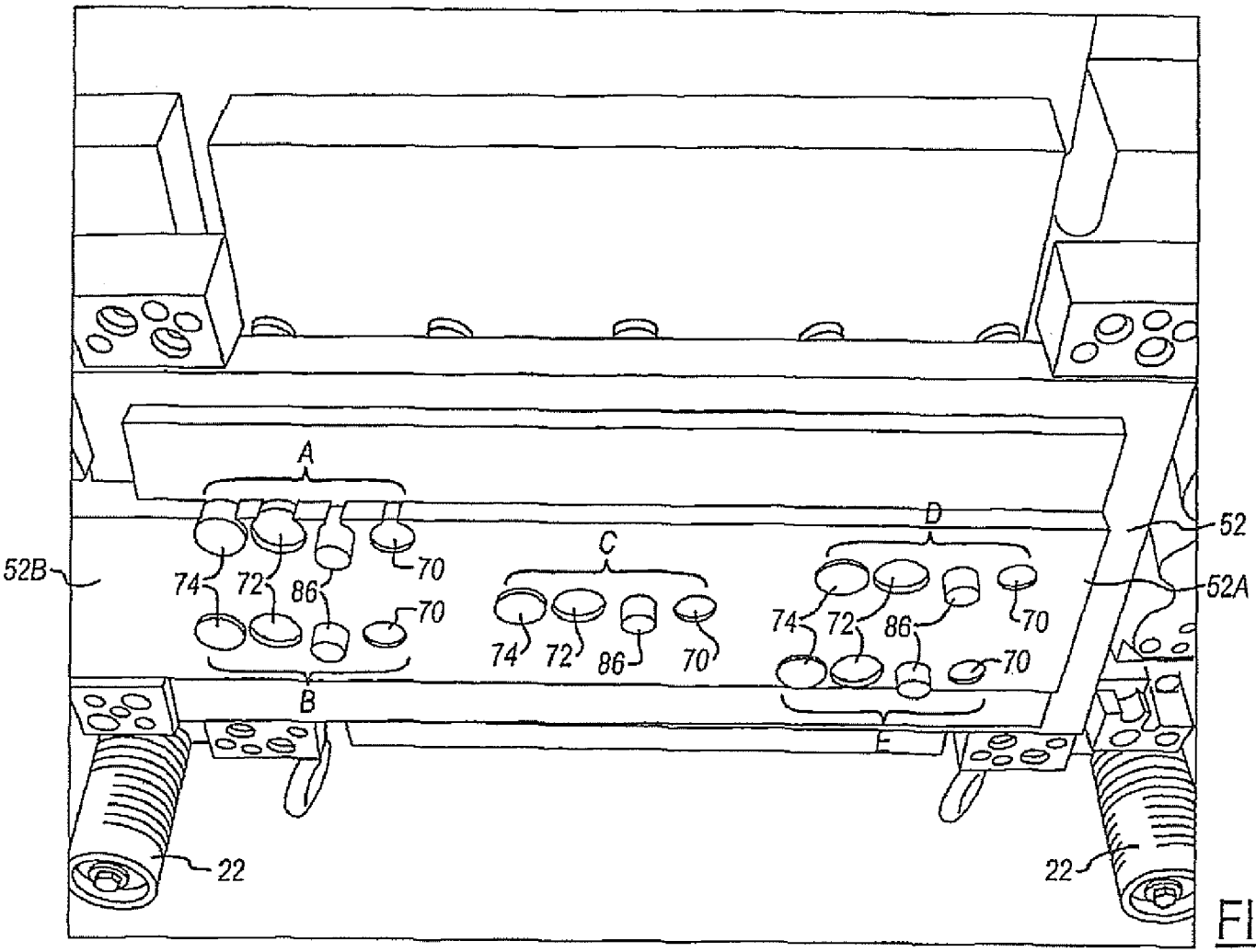
FIG. 3 is a perspective showing one of the die members of a progressive stamping die in accordance with the present invention.

FIG. 3 is a perspective or schematic view the upper or first die member 52. As shown, five sets or punch members A, B, C, D, and E, are provided in this embodiment. Each of the sets or series of punch members includes a punch 70, a pilot member 86, a coin punch member 72, and a knockout punch member 74. In this manner, when the work piece member, such as work piece 80, travels from the first end 52A of the progressive stamping die 50 to the second end 52B, five ring members 32 are formed per unit of surface area and deposited into the parts compartment 92.

Figure 4:
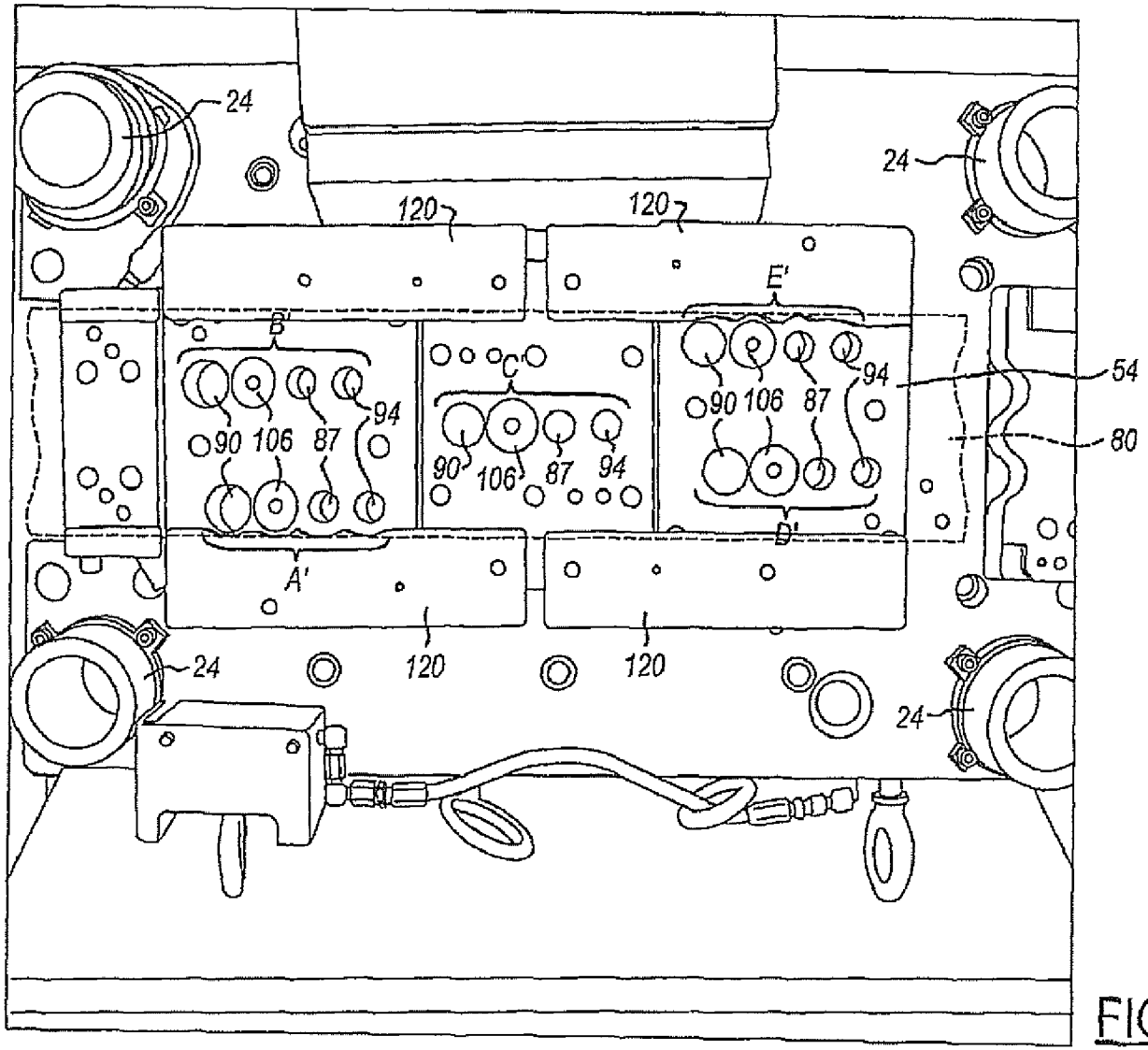
FIG. 4 schematically illustrates the second die member of a progressive stamping die in accordance with the present invention.

A plan or elevational view of the second or lower die member 54 is shown in FIG. 4. Five corresponding sets of openings and other members, A", B", C", D" and E", are provided in order to meet and mate with the sets or series of punch members A, B, C, D, and E, respectively. These include a scrap chute member 94, and a part chute member 90. They also include openings 87 for a positioning of the pilot members 86, which are used to index the work piece member. In this regard, the work piece member 80 is shown in hidden lines in FIG. 4 for reference. The anvil or puck member 106 which are part of the biasing mechanisms 30 are also shown in FIG. 4.

In order to assist in positioning the work piece member 80 and allow it to progressively accurately slide along the upper surface of the lower die member, several side guide members 120 are provided. The side guide members 120 provide a channel (not shown) between the side guide members 120 and the surface of the die member 54.

It is also important to maintain the tonnage force of the stamping machine above a predetermined minimum amount in order to provide the requisite thickness and flatness of the stamped metal ring members. For this purpose, a tonnage monitor 15O is provided on the stamping machine which records the force of each stroke (or "punch") of the machine. If the tonnage, e.g. 45–53 tons, is below or above the present minimum amount, the stamping process will be stopped. It also possible to use a load cell 16O for the same purpose.

Figure 5:
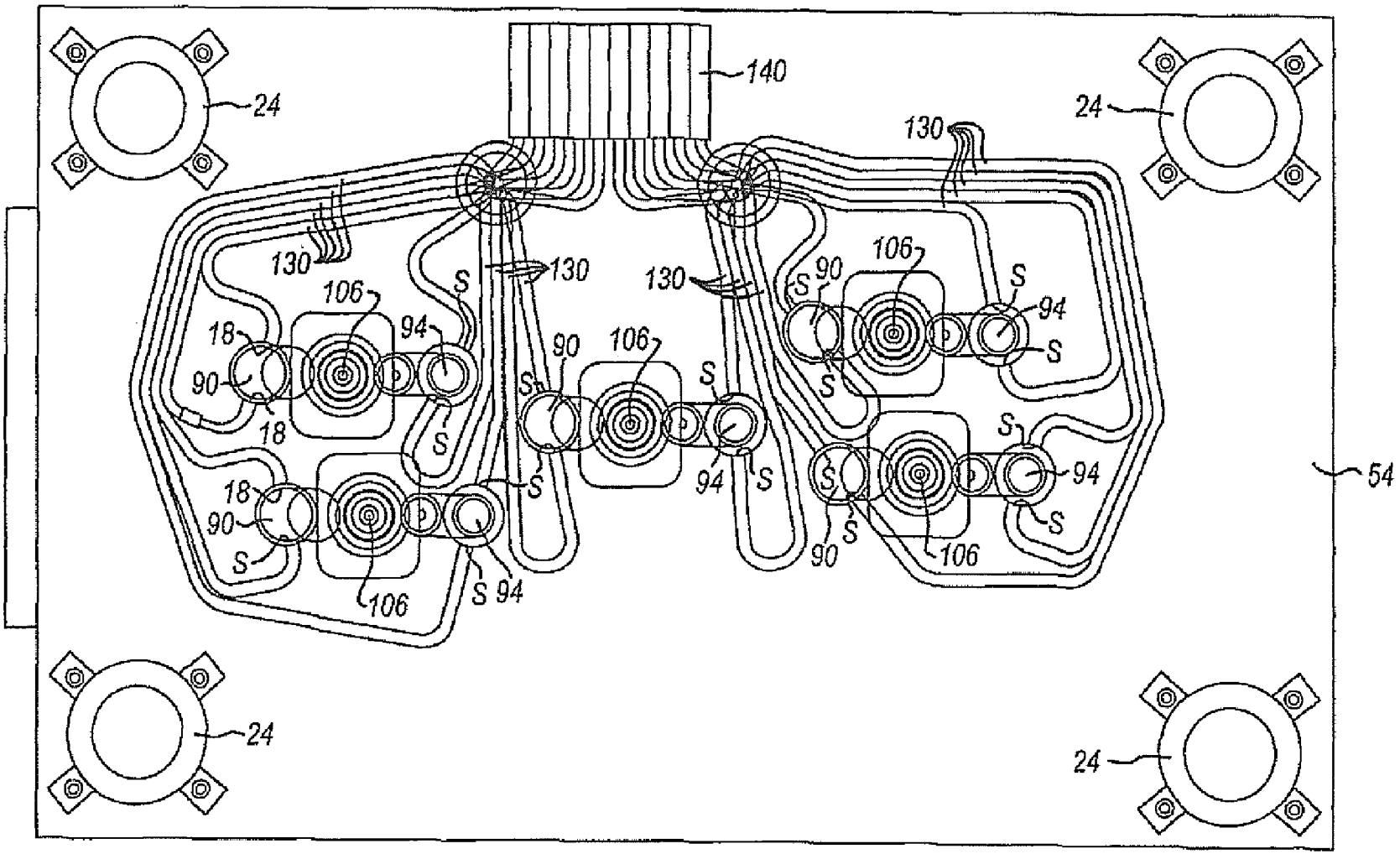
FIG. 5 is a schematic plan diagram showing a sensor system in accordance with the present invention.

Another aspect of the present invention is shown in FIG. 5. A plurality of sensor members S are provided in the lower or second die member 54 in order to ensure completion of some of the steps in the progressive stamping die process and thus prevent damage to the die. In this regard, pairs of sensors are provided at each of the openings of the scrap chutes 94 as well as the part chutes 90. The sensors S are provided immediately below the surface of the die member 54 and are utilized to sense whether a scrap piece member 82 or a ring member 32 is actually pushed into its corresponding chute. The sensors S are connected by conventional electric conduits 130 to a bus member 140 to an appropriate electrical monitoring control system (not shown).

If one of the sensors S do not indicate that a pierced member 82 or a ring member 32 is actually detached from the work piece member 80, then the progressive stamping die process is immediately shut down until the situation is corrected.

While particular embodiments of the invention have been shown and described, numerous variations and alternate embodiments will occur to those skilled in the art. Accordingly, it is intended that the invention be limited only in terms of the appended claims.

The invention claimed is:

1. A progressive stamping die for forming a product from a work piece comprising:

a first die member;

a second die member;

an alignment mechanism for maintaining said first and second die members in axial alignment;

a pierce punch member in said first die member for punching an opening in a work piece positioned between said first and second die members;

at least one pilot member in said first die member for indexing a work piece positioned between said first and second die members;

a coin punch member in said first die member for forming a product from a work piece positioned between said first and second die member;

a biasing member in said second die member in axial alignment with said coin punch member;

a knockout punch member for removing a product from a work piece positioned between said first and second die member; and at least one sensor member in said second die member for determining whether an opening has been formed in a work piece or whether a product has been removed from a work piece.

2. A progressive stamping die for forming a product from a work piece in claim 1 wherein said biasing member comprises a gas spring member.

3. A progressive stamping die for forming a product from a work piece in claim 1 wherein said biasing member comprises a mechanical spring member.

4. A progressive stamping die for forming a product from a work piece in claim 1 further comprising an anvil member positioned adjacent said biasing member and in axial alignment with said coin punch member.

5. The progressive stamping die for forming a product from a work piece in claim 4 wherein said anvil member comprises a puck member, a bottoming disk member, a bottoming ring member, and a return pin member.

6. The progressive stamping die for forming a product from a work piece in claim 1 further comprising a scrap chute in said second die member at least in part in axial alignment with said pierce punch member.

7. The progressive stamping die for forming a product from a work piece in claim 1 further comprising a product collection chute in said second die member at least in part in axial alignment with said knockout punch member.

8. A progressive stamping die for forming a product from a work piece as described in claim 1 wherein a pair of sensor members are provided for determining whether an opening has been formed in a work piece or whether a product has been removed from a work piece.

9. A progressive stamping die for forming a product from a work piece as described in claim 1 wherein at least one sensor member is provided for determining whether an opening has been found in a work piece and at least one sensor is provided for determining whether a product has been removed from a work piece.

10. A progressive stamping die for forming a plurality of products from a work piece comprising:

a first die member;

a second die member;

an alignment mechanism for maintaining said first and second die member in axial alignment;

at least two sets of punch members in said first die member with corresponding sets of biasing mechanisms and chute means in said second die member;

each of said sets of punch members comprising a pierce punch member, a coin punch member and a knockout punch member;

each of said sets of biasing mechanisms comprising a spring member positioned in axial alignment with one of said coin punch member; and at least one sensor member in said second die member for determining that a product is formed from a work piece.

11. The progressive stamping die for forming a plurality of products from a work piece in claim 10 wherein said spring member is a gas spring member.

12. The progressive stamping die for forming a plurality of products from a work piece in claim 10 wherein said spring member is a mechanical spring member.

13. The progressive stamping die for forming a plurality of products from a work piece in claim 10 wherein said biasing mechanism further comprises at least one anvil member.

14. The progressive stamping die for forming a plurality of products from a work piece in claim 13 wherein each of said anvil members comprises a puck member, a bottom disk member, a bottoming member, and a return pin member.

15. The progressive stamping die for forming a plurality of products from a work piece in claim 10 wherein each of said chute means comprises a scrap chute at least in part in axial alignment with said piece punch member and a product collection chute in axial alignment at least in part with said knockout punch member.

16. A method of forming a metal ring member from a work piece with a progressive stamping die, said method comprising the steps of:

positioning a work piece between a first stamping die member and a second stamping die member;

forming an opening in said work piece with a pierce punch member;

indexing said work piece in said die member with at least one pilot member;

forming an annular ring member around the opening with a coin punch member, said annular ring member having a predetermined thickness and flat planar dimension by use of a biasing mechanism in axial alignment with said coin punch member; and removing said formed annular ring member from said die with a knockout punch member.

17. The method of forming a metal ring member from a work piece with a progressive stamping die in claim 16 wherein said biasing mechanism comprises a gas spring mechanism.

18. The method of forming a metal ring member from a work piece with a progressive stamping die in claim 16 wherein said biasing mechanism comprises a mechanical spring member.

19. A progressive stamping die for forming a product from a work piece comprising:

a first die member;

a second die member;

an alignment mechanism for maintaining said first and second die members in axial alignment;

a pierce punch member in said first die member for punching an opening in a work piece positioned between said first and second die members;

at least one pilot member in said first die member for indexing a work piece positioned between said first and second die members;

a coin punch member in said first die member for forming a product from a work piece positioned between said first and second die member;

a biasing member in said second die member in axial alignment with said coin punch member;

an anvil member positioned adjacent said biasing member and in axial alignment with said coin punch member, said anvil member comprises a puck member, a bottoming disk member, a bottoming ring member, and a return pin member; and a knockout punch member for removing a product from a work piece positioned between said first and second die member.

20. A progressive stamping die for forming a product from a work piece in claim 19 wherein said biasing member comprises a gas spring member.

21. A progressive stamping die for forming a product from a work piece in claim 19 wherein said biasing member comprises a mechanical spring member.

22. The progressive stamping die for forming a product from a work piece in claim 19 further comprising a scrap chute in said second die member at least in part in axial alignment with said pierce punch member.

23. The progressive stamping die for forming a product from a work piece in claim 19 further comprising a product collection chute in said second did member at least in part in axial alignment with said knockout punch member.

24. A progressive stamping die for forming a product from a work piece comprising:

a first die member;

a second die member;

an alignment mechanism for maintaining said first and second die members in axial alignment;

a pierce punch member in said first die member for punching an opening in a work piece positioned between said first and second die members;

a scrap chute in said second die member at least in part in axial alignment with said pierce punch member;

at least one pilot member in said first die member for indexing a work piece positioned between said first and second die members;

a coin punch member in said first die member for forming a product from a work piece positioned between said first and second die member;

a biasing member in said second die member in axial alignment with said coin punch member; and a knockout punch member for removing a product from a work piece positioned between said first and second die member.

25. A progressive stamping die for forming a product from a work piece in claim 24 wherein said biasing member comprises a gas spring member.

26. A progressive stamping die for forming a product from a work piece in claim 24 wherein said biasing member comprises a mechanical spring member.

27. A progressive stamping die for forming a product from a work piece in claim 24 further comprising an anvil member positioned adjacent said biasing member and in axial alignment with said coin punch member.

28. The progressive stamping die for forming a product from a work piece in claim 27 wherein said anvil member comprises a puck member, a bottoming disk member, a bottoming ring member, and a return pin member.

29. The progressive stamping die for forming a product from a work piece in claim 24 further comprising a product collection chute in said second did member at least in part in axial alignment with said knockout punch member.

30. A progressive stamping die for forming a plurality of products from a work piece comprising:

a first die member;

a second die member;

an alignment mechanism for maintaining said first and second die member in axial alignment; and at least two sets of punch members in said first die member with corresponding sets of biasing mechanisms and chute means in said second die member;

each of said sets of punch members comprising a pierce punch member, a coin punch member and a knockout punch member;

each of said sets of biasing mechanisms comprising a spring member positioned in axial alignment with one of said coin punch members and at least one anvil member, each of said anvil members comprising a puck member, a bottom disk member, a bottoming member, and a return pin member.

31. The progressive stamping die for forming a plurality of products from a work piece in claim 30 wherein said spring member is a gas spring member.

32. The progressive stamping die for forming a plurality of products from a work piece in claim 30 wherein said spring member is a mechanical spring member.

33. The progressive stamping die for forming a plurality of products from a work piece in claim 30 wherein each of said chute means comprises a scrap chute at least in part in axial alignment with said piece punch member and a product collection chute in axial alignment at least in part with said knockout punch member.

34. The progressive stamping die for forming a plurality of products from a work piece in claim 30 further comprising at least one sensor member in said second die member for determining whether a product has been formed from a work piece.

35. A progressive stamping die for forming a plurality of products from a work piece comprising:

a first die member;

a second die member;

an alignment mechanism for maintaining said first and second die member in axial alignment;

at least two sets of punch members in said first die member with corresponding sets of biasing mechanisms and chute means in said second die member;

each of said sets of punch members comprising a pierce punch member, a coin punch member and a knockout punch member;

each of said sets of biasing mechanisms comprising a spring member positioned in axial alignment with one of said coin punch members; and each of said chute means comprising a scrap chute at least in part in axial alignment with said pierce punch member and a product collection chute in axial alignment at least in part with said knockout punch member.

36. The progressive stamping die for forming a plurality of products from a work piece in claim 35 wherein said spring member is a gas spring member.

37. The progressive stamping die for forming a plurality of products from a work piece in claim 35 wherein said spring member is a mechanical spring member.

38. The progressive stamping die for forming a plurality of products from a work piece in claim 35 wherein said biasing mechanism further comprises at least one anvil member.

39. The progressive stamping die for forming a plurality of products from a work piece in claim 38 wherein each of said anvil members comprises a puck member, a bottom disk member, a bottoming member, and a return pin member.

40. The progressive stamping die for forming a plurality of products from a work piece in claim 35 further comprising at least one sensor member in said second die member for determining whether a product has been formed from a work piece.

* * * * *

UNITED STATES PATENT AND TRADEMARK OFFICE

CERTIFICATE OF CORRECTION

PATENT NO. : 7,055,353 B2
APPLICATION NO. : 10/710687
DATED : June 6, 2006
INVENTOR(S) : Ralph Cowie It is certified that error appears in the above-identified patent and that said Letters Patent is hereby corrected as shown below:

Column 6, line 53, should read as follows:

-- of said coin punch members: and --

Column 8, line 3, should read as follows:

-- collection chute in said second die member at least in part --

Column 8, line 44, should read as follows:

-- collection chute in said second die member at least in part --

Column 9, line 7, should read as follows:

-- axial alignment with said pierce punch member and a product --

Signed and Sealed this

Thirtieth Day of January, 2007

JON W. DUDAS
*Director of the United States Patent and Trademark Office*